US006032643A

United States Patent [19]

Hosaka et al.

[11] Patent Number: 6,032,643

[45] Date of Patent: Mar. 7, 2000

[54] DECOMPRESSION ENGINE BRAKE DEVICE OF AUTOMOTIVE INTERNAL COMBUSTION ENGINE

[75] Inventors: Noriomi Hosaka; Tamotsu Todo; Seiji Tsuruta, all of Kanagawa, Japan

[73] Assignee: Unisia Jecs Corporation, Atsugi, Japan

[21] Appl. No.: 09/061,341

[22] Filed: Apr. 17, 1998

[30] Foreign Application Priority Data

Apr. 17, 1997 [JP] Japan ..... 9-100470

[51] Int. Cl.[7] ..... F02D 13/04

[52] U.S. Cl. ..... 123/321; 123/90.16; 123/198 F

[58] Field of Search ..... 123/321, 90.16, 123/198 F, 90.48

[56] References Cited

U.S. PATENT DOCUMENTS

| | | | |
|---|---|---|---|
| 5,103,779 | 4/1992 | Hare, Sr. | 123/321 |
| 5,163,389 | 11/1992 | Fujikawa et al. | 123/321 |
| 5,287,830 | 2/1994 | Dopson et al. | 123/90.16 |
| 5,743,226 | 4/1998 | Tohdoh et al. | 123/90.16 |
| 5,832,884 | 11/1998 | Haas et al. | 123/90.16 |

FOREIGN PATENT DOCUMENTS

| | | |
|---|---|---|
| 63-78142 | 5/1988 | Japan . |
| 2-96406 | 8/1990 | Japan . |

*Primary Examiner*—John Kwon
*Attorney, Agent, or Firm*—Foley & Lardner

[57] ABSTRACT

A decompression engine brake device is incorporated with an internal combustion engine. The device comprises an exhaust valve arranged to open and close an exhaust port of a combustion chamber of the engine. A valve stem extends from the exhaust valve. A valve lifter is slidably disposed in a cylinder head of the engine. The valve lifter has the valve stem contacting thereto. An exhaust cam disposed about an exhaust cam shaft is operatively engageable with the valve lifter to actuate the exhaust valve in accordance with a contour of the exhaust cam. An engine brake cam is defined by the exhaust cam. A hydraulically operating device is employed for inducing an operative engagement between the engine brake cam with the valve lifter thereby to actuate the exhaust valve in accordance with a contour of the engine brake cam.

14 Claims, 6 Drawing Sheets

DECOMPRESSION ENGINE BRAKE DEVICE OF AUTOMOTIVE INTERNAL COMBUSTION ENGINE

BACKGROUND OF THE INVENTION

1. Field of the Invention

The present invention relates in general to engine brake devices incorporated with an automotive internal combustion engine, and more particularly to decompression engine brake devices of a type which can exhibit higher engine braking effect irrespective of a simple construction thereof.

2. Background of the Invention

In automotive diesel engines, there is a type which has no throttle valve. For simplification of description, such type diesel engines will be referred to as "NTVDE" (viz., no throttle valve diesel engine). As is known, the throttle valve is an effective means for producing a negative pressure which produces a power for the engine braking. Thus, in motor vehicles powered by "NTVDE", there is such a tendency that the engine braking obtained by such vehicles is poor as compared with that obtained by motor vehicles powered by an engine having a throttle valve.

In view of the above, various engine brake devices have been hitherto proposed and put into practical use to provide the vehicle powered by the "NTVDE" with a satisfied engine braking, some of which are described in Japanese Utility Model First Provisional Publications No. 63-78142 and 2-96406. These are of a so-called decompression type.

In the device of the '142 publication, an extra exhaust valve is provided in addition to usual exhaust valves, which can open and close the exhaust port of the engine. That is, when, under compression stroke, a corresponding piston moves up near a top dead center, a hydraulic actuator actuates the extra exhaust valve to open to induce engine braking. While, in the device of the '406 publication, given one of paired exhaust valves actuated by a rocker arm is used for carrying out the engine braking. That is, when, under compression stroke, a corresponding piston moves up near a top dead center, a hydraulically actuated stopper arm actuates the given exhaust valve to open to induce engine braking. However, even the above-mentioned engine brake devices have failed to give satisfaction to users due to their complicated and high cost construction.

SUMMARY OF THE INVENTION

It is therefore an object of the present invention to provide a decompression engine brake device of an automotive internal combustion engine, which can give satisfaction to uses due to its simple and low cost construction.

According to a first aspect of the present invention, there is provided a decompression engine brake device for use with an internal combustion engine. The engine brake device comprises an exhaust valve arranged to open and close an exhaust port extending from a combustion chamber of the engine; a valve stem extending from the exhaust valve; a valve lifter slidably disposed in a cylinder head of the engine, the valve lifter having the valve stem contacting thereto; an exhaust cam shaft; an exhaust cam disposed about the exhaust cam shaft and operatively engageable with the valve lifter to actuate the exhaust valve in accordance with a contour of the exhaust cam; an engine brake cam defined by the exhaust cam; and a unit for inducing an operative engagement between the engine brake cam with the valve lifter thereby to actuate the exhaust valve in accordance with a contour of the engine brake cam.

According to a second aspect of the present invention, there is provided a decompression engine brake device for use with an internal combustion engine. The engine brake device comprises an exhaust valve arranged to open and close an exhaust port extending from a combustion chamber of the engine; a valve step extending from the exhaust valve; a valve lifter slidably disposed in a cylinder head of the engine, the valve lifter having the valve stem contacting thereto; a first biasing member for biasing the valve lifter and thus the exhaust valve in a direction to close the exhaust port; an exhaust cam shaft positioned above the valve lifter; an exhaust cam disposed about the exhaust cam shaft and operatively engageable with the valve lifter to actuate the exhaust valve in accordance with a contour of the exhaust cam; an engine brake cam defined by the exhaust cam; a plunger axially movably held by the valve lifter, the plunger having an upper end which is operatively engageable with the engine brake cam when the plunger assumes a projected position; a bore formed in the valve lifter; a slider slidably disposed in the bore; a biasing member for biasing the slider in a first direction; an oil chamber defined by the bore, the oil chamber biasing the slider in a second direction when fed with a pressurized oil, the second direction being opposite to the first direction; and an inclined surface defined by the slider, the inclined surface being slidably engaged with a lower end of the plunger, so that when the slider is moved in the second direction by the pressurized oil, the inclined surface pushes up the plunger to cause the same to take the projected position.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENT

Figure 1:
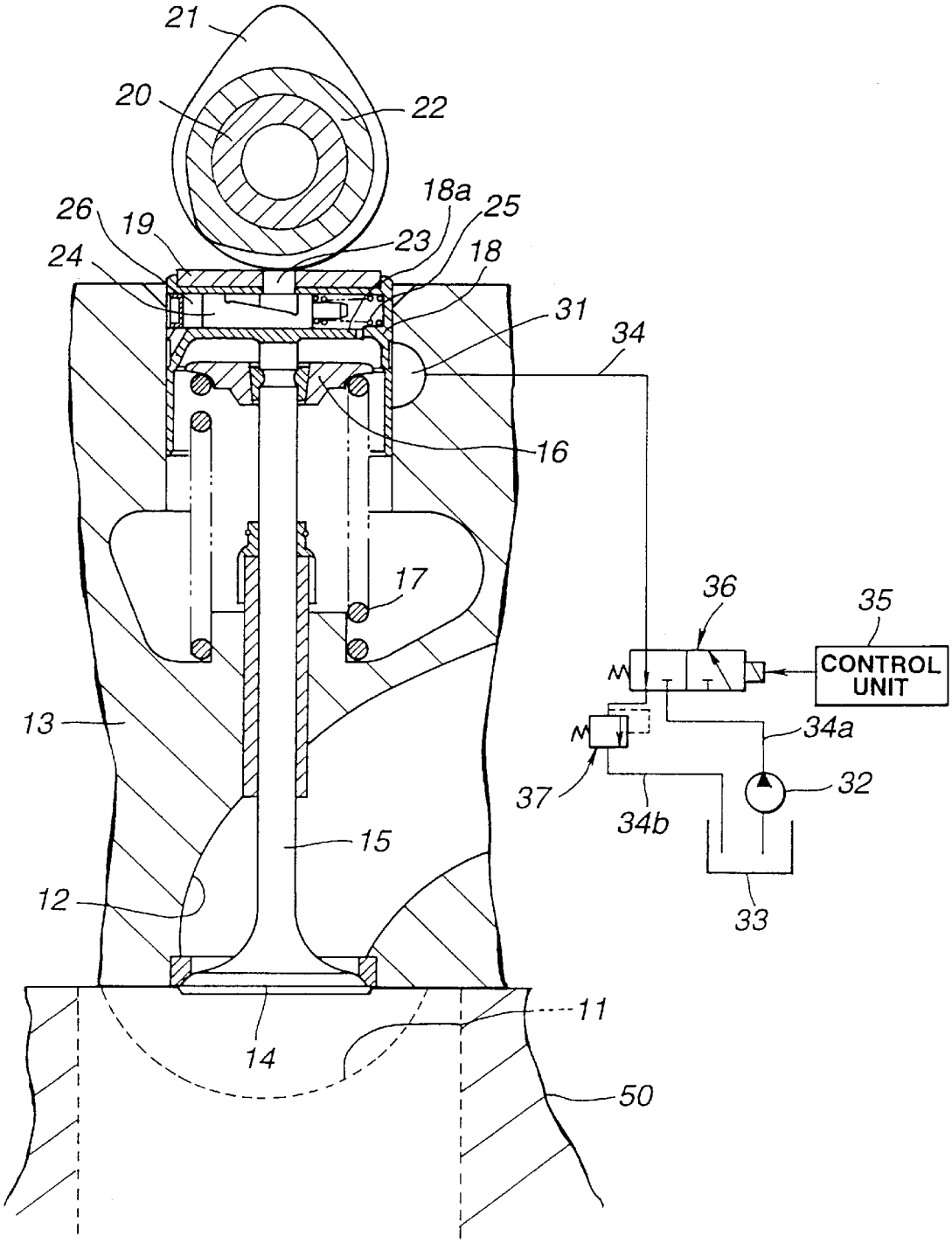
FIG. 1 is a schematic and partially sectioned view of a decompression engine brake device incorporated with an automotive diesel engine, which is an embodiment of the present invention.

Referring to FIGS. 1 to 6, particularly FIG. 1, there is shown a decompression engine brake device incorporated with an automotive diesel engine, which is an embodiment of the present invention. The diesel engine shown has a valve drive mechanism of direct drive type.

In FIG. 1, there is partially shown a cylinder head 13 of the diesel engine, which is formed with an exhaust port 12 extending upward from a combustion chamber 11 defined by a cylinder block 50. An exhaust valve 14 is operatively installed in the exhaust port 12 to open and close the same. A valve stem 15 extending upward from the valve 14 has a spring retainer 16 mounted thereto. Disposed between the spring retainer 16 and the cylinder head 13 is a valve spring 17 by which the exhaust valve 14 is biased upward, that is, in a direction to close the exhaust port 12. An upper end of the valve stem 15 contacts a cup-shaped valve lifter 18 which is slidably disposed in a bore of the cylinder head 13. As shown, the valve lifter 18 receives therein the spring retainer 16. The valve lifter 18 has a circular shim 19 detachably fixed to an upper side thereof, as shown. An exhaust cam 21 disposed about an exhaust cam shaft 20 is in contact with the circular shim 19, so that under rotation of the exhaust cam shaft 20, the exhaust valve 14 opens and closes the exhaust port 12 in accordance with a contour of the exhaust cam 21. To adjust the valve clearance of the exhaust valve 14, the shim 19 may be replaced with-other having a different thickness.

Figure 2:
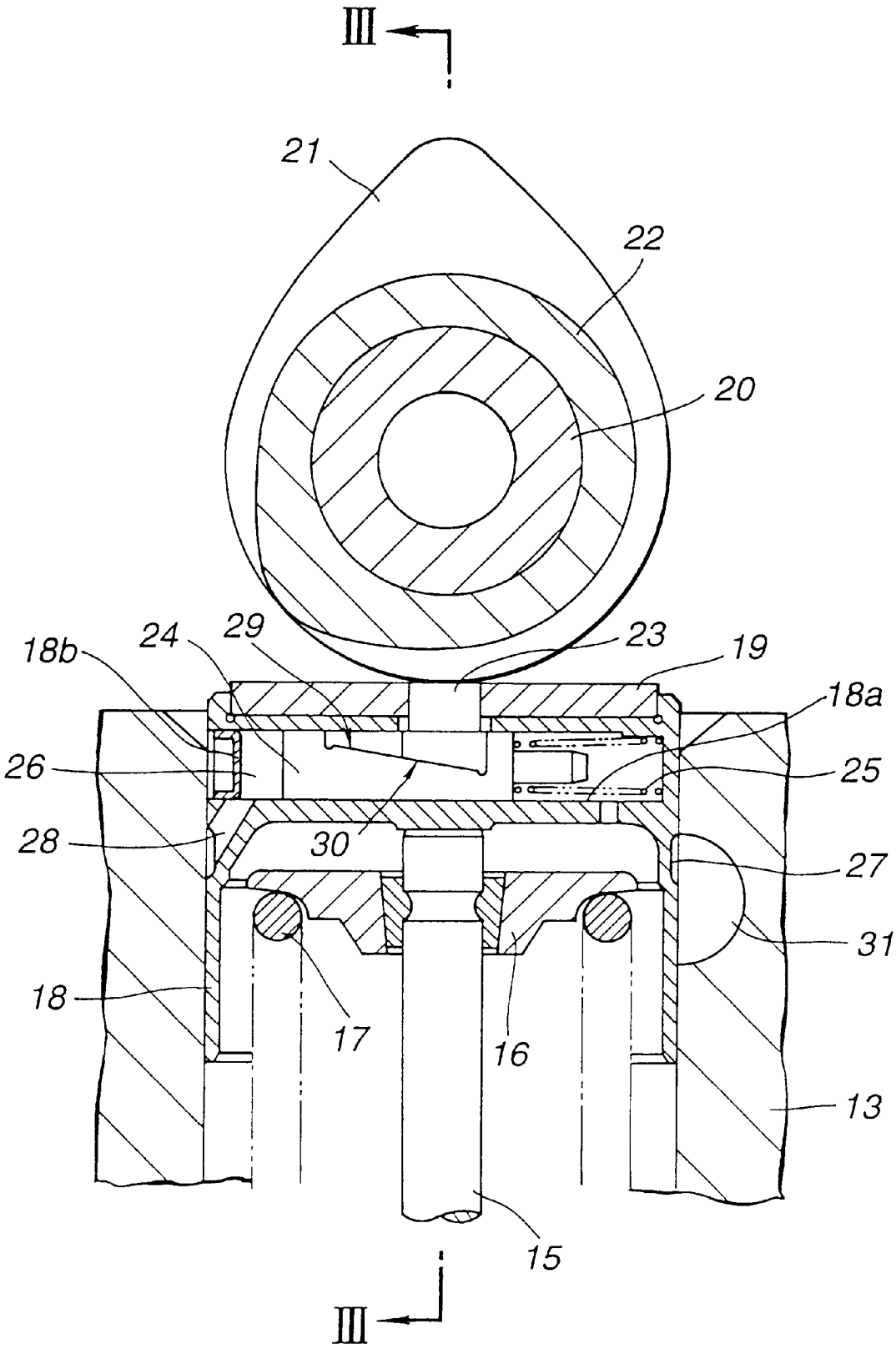
FIG. 2 is an enlarged sectional view of an essential portion of the engine brake device of the invention.
Figure 3:
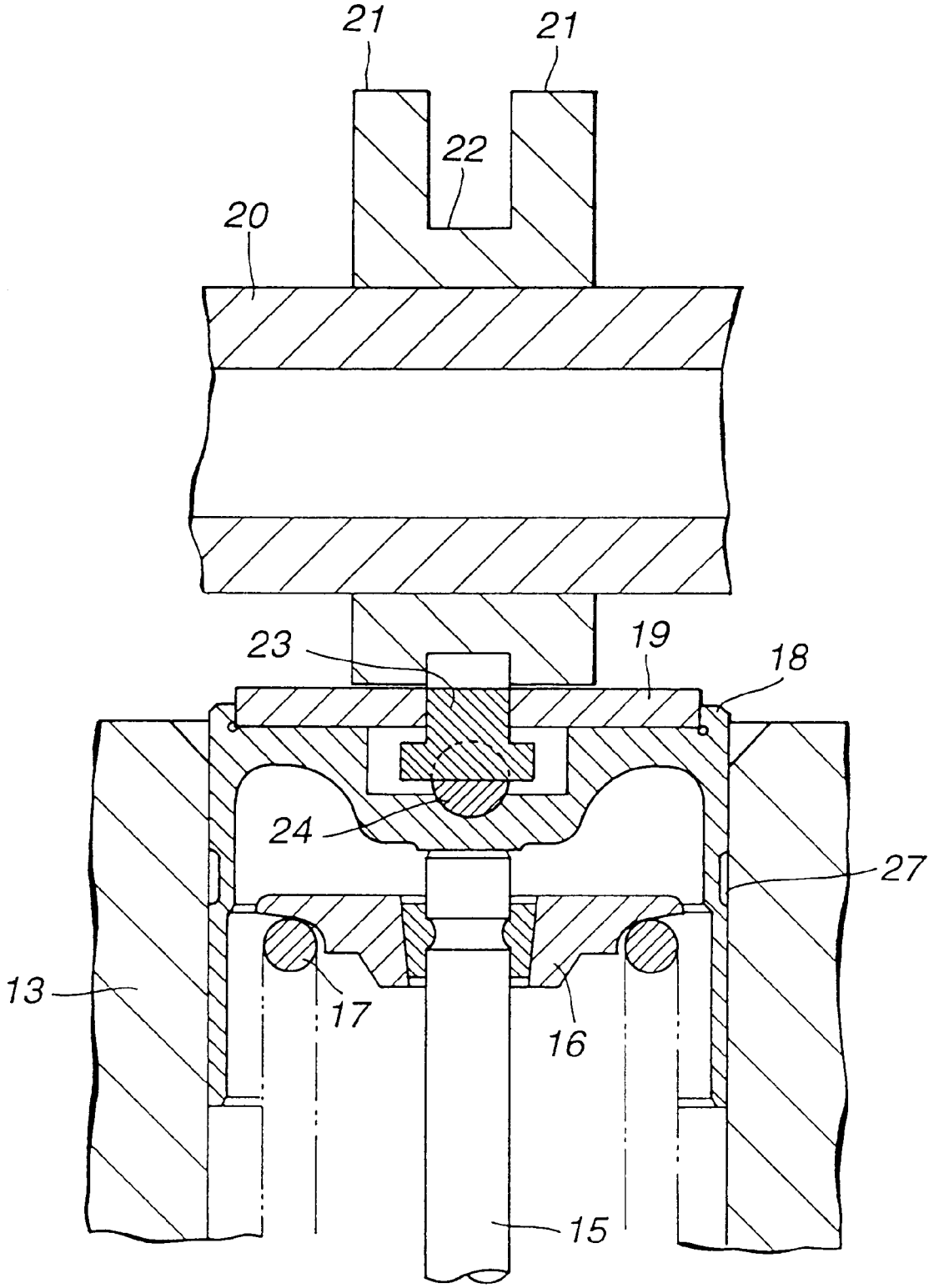
FIG. 3 is a sectional view taken along the line III—III of FIG. 2.

As is understood from FIG. 3, the exhaust cam 21 is formed thereabout with a groove (22) whose bottom surface constitutes a periphery or contour of an engine brake cam 22. As is understood from FIGS. 1 and 2, the engine brake cam 22 can contact an upper end of a plunger 23 which passes through a center of the circular shim 19. The plunger 23 is well shown in FIG. 4, which will be described in detain hereinafter.

As is seen from FIG. 2, the valve lifter 18 is formed with a diametrically extending bore 18*a* in which a slider 24 is slidably received. Due to presence of the slider 24, the bore 18*a* has at both sides two chambers, one being a first chamber defined between one end of the slider 24 and a bottom wall of the bore 18*a*, the other being a second chamber (26) defined between the other end of the slider 24 and a plug 18*b* fitted to an open end of the bore 18*a*. In the first chamber, there is compressed a return spring 25 by which the slider 24 is biased in a given direction, that is, leftward in FIG. 2. The second chamber (26) serves as an oil chamber 26. The oil chamber 26 communicates through a passage 28 with an annular groove 27 which is formed around the cylindrical outer wall of the valve lifter 18.

Figure 4:
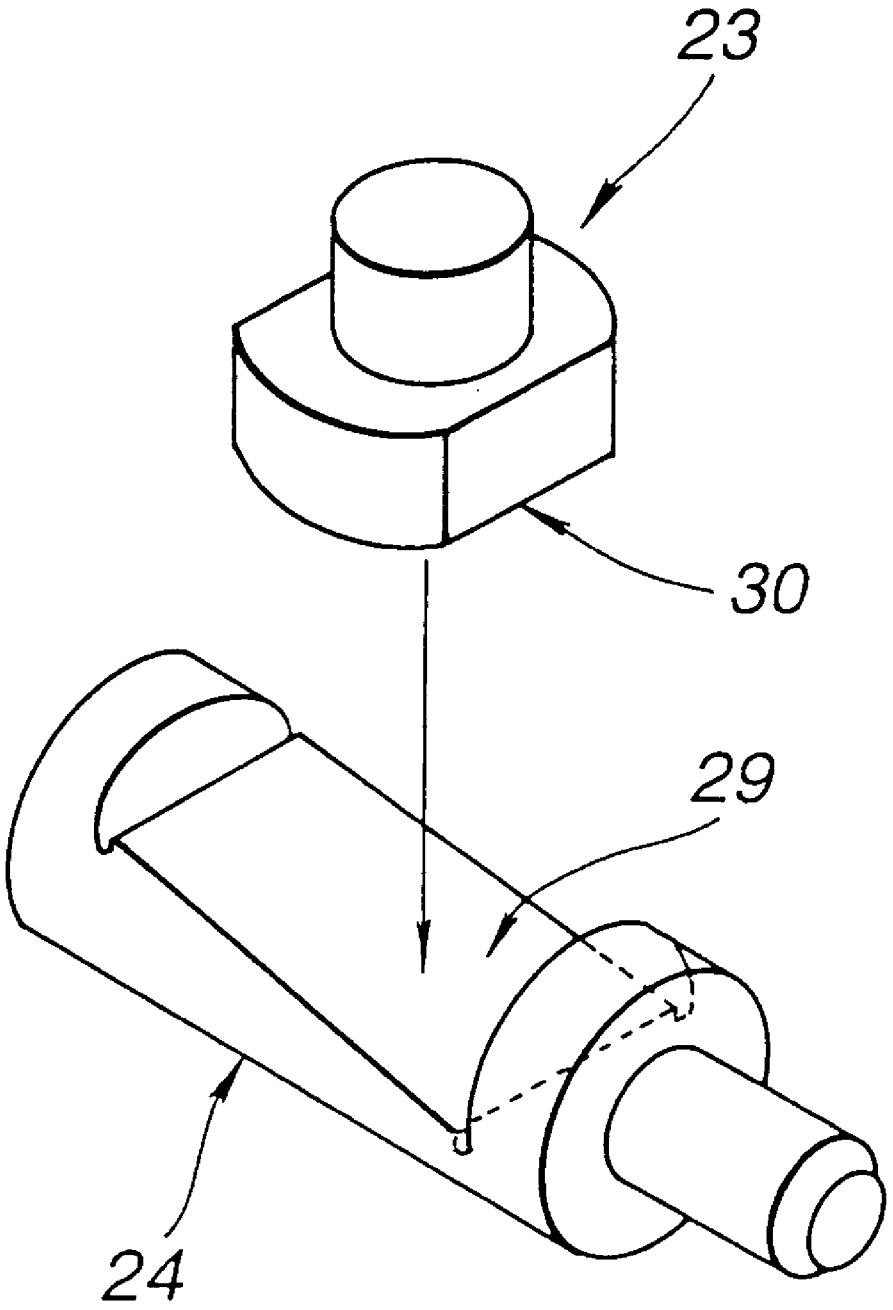
FIG. 4 is a perspective view of a slider and a plunger which are employed in the present invention.

As is understood from FIG. 4, the above-mentioned plunger 23 is incorporated with the slider 24. That is, the slider 24 is formed with an axially extending recess whose bottom surface 29 is inclined with respect to a longitudinal axis of the slider 24. As is seen from FIG. 2, the inclination of the bottom surface 29 is so made that the depth of the recess gradually increases with increase of distance from the oil chamber 26.

Referring back to FIG. 4, the plunger 23 is formed with an inclined lower surface 30 which is slidably engaged with the inclined bottom surface 29 of the slider 24. Preferably, the inclination angle of the bottom surface 29 and thus that of the lower surface 30 are about 10° relative to a flat surface of the circular shim 19.

Figure 5:
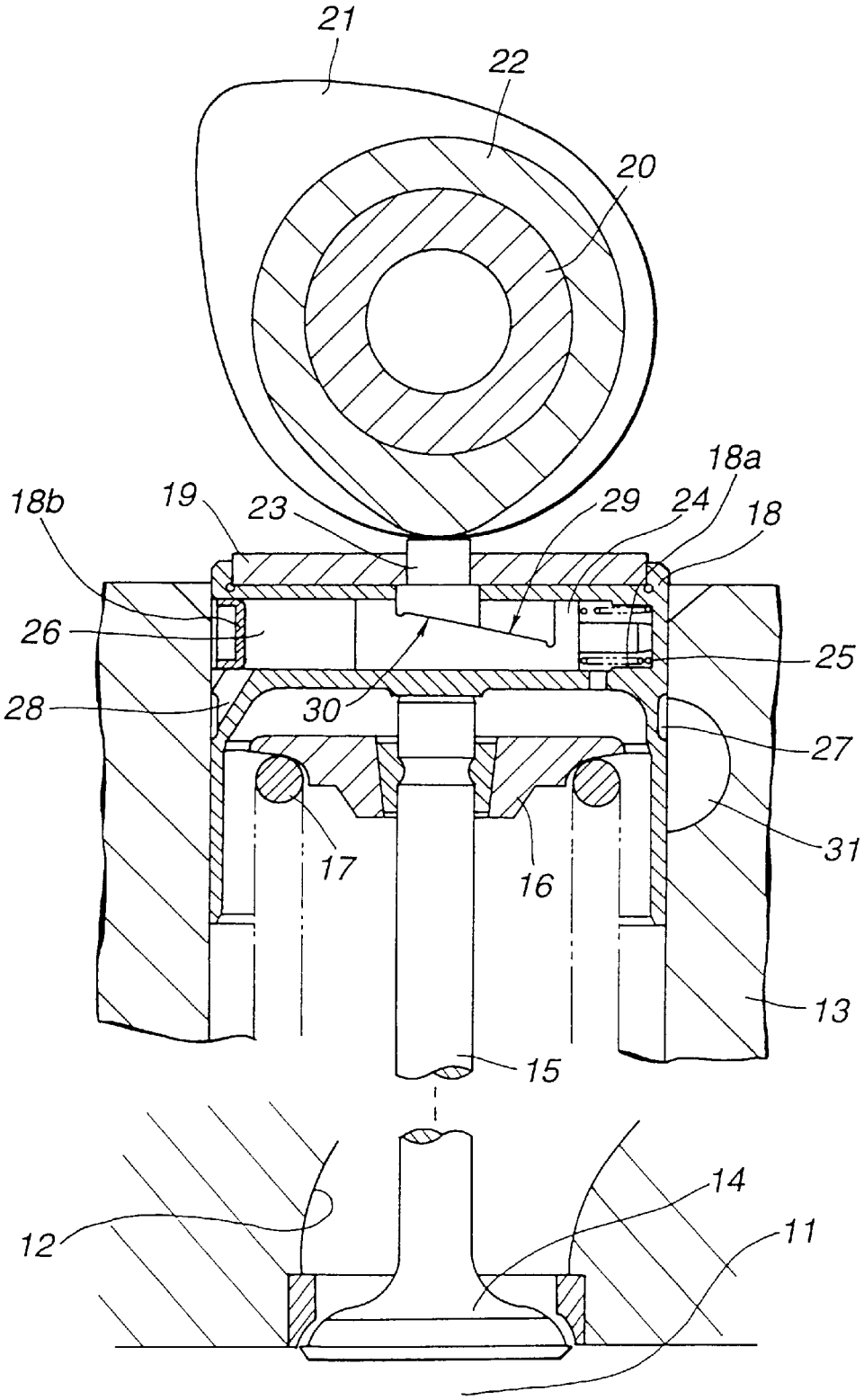
FIG. 5 is a view similar to FIG. 2, but showing an operative condition of the engine brake device.

When the slider 24 is moved from a rest position as shown in FIG. 2 to a work position as shown in FIG. 5, the plunger 23 is pushed up by the slider 24 to take an upper position as shown in FIG. 5. In this upper position, an upper end of the plunger 23 is projected beyond an upper flat surface of the shim 19 and thus slidably engageable with the engine brake cam 22. As will become apparent hereinafter, when the oil chamber 26 is fed with a pressurized oil, the slider 24 is moved to the work position and thus the plunger 23 assumes the upper position, while, when the pressurized oil in the oil chamber 26 is drained, the slider 24 is forced to assume the rest position due to work of the return spring 25 and thus the plunger 23 assumes a lower position wherein as is seen from FIGS. 1, 2 and 3, the upper end of the plunger 23 is flush with the upper flat surface of the shim 19 and thus not engageable with the engine brake cam 22.

Referring back to FIG. 2, the above-mentioned annular groove 27 formed around the valve lifter 18 communicates with an oil gallery 31 formed in the cylinder head 13. As is seen from FIG. 1, from the oil gallery 31, there extends an oil passage 34 to an electromagnetic switching valve 36 which is controlled by a control unit 35 in accordance with an operating condition of an associated motor vehicle. From the switching valve 36 to an oil reservoir 33, there extends both an oil feeding passage 34*a* and an oil draining passage 34*b*. The feeding passage 34*a* has an oil pump 32 connected thereto, and the draining passage 34*b* has a relief valve 37 connected thereto. As is seen from the drawing, the electromagnetic switching valve 36 switches between an oil feeding position wherein the oil is fed to the oil passage 34 (thus, to the oil gallery 31) from the reservoir 33 due to work of the oil pump 32 and an oil draining position wherein as is shown in FIG. 1 the oil in the oil passage 34 (thus, in the oil gallery 31) is drained to the oil reservoir 33 through the relief valve 37.

Upon receiving an information signal from a sensor (not shown) which senses movement of an acceleration pedal actuated by a driver during cruising of the vehicle, the control unit 35 judges whether the driver really wants an engine braking or not. If YES, that is, when the judgement is so made that the driver really wants the engine braking, the control unit 35 energizes the switching valve 36 to shift the same to the oil feeding position. Upon this, due to work of the oil pump 32, the oil in the oil reservoir 33 is fed to the oil chamber 26 for the slider 24 through the feeding passage 34*a*, the oil passage 34, the oil gallery 31, the annular groove 27 and the passage 28. If NO, that is, when the judgement is so made that the driver does not want the engine braking, the control unit 35 does not energize the switching valve 36. Under this condition, the switching valve 36 assumes the oil draining position. It is to be noted that the slider 24, the return spring 25, the inclined bottom surface 29, the inclined lower surface 30, the oil pump 32, the oil passage 34, the switching valve 36, control unit 35, the feeding passage 34*a*, the draining passage 34*b*, the relief valve 37 and the oil reservoir 33 constitute a driving means which drives the plunger 23.

If desired, in place of the control unit 35, a manually operated engine brake switch connected to the electromagnetic switching valve 36 may be used. That is, in this case, when the engine brake switch is turned ON by the driver, the switching valve 36 is energized to assume the oil feeding position.

In the following, operation of the decompression engine brake device of the invention will be described with reference to the drawings.

For ease of understanding, the explanation will be commenced with respect to a normal condition of the engine wherein the engine braking is not carried out.

That is, in this normal condition, the electromagnetic switching valve 36 assumes the oil draining position, and thus, as is seen from FIGS. 1, 2 and 3, the plunger 23 assumes the lower position. Thus, the exhaust valve 14 is actuated by the exhaust cam 21, not by the engine brake cam 22.

Figure 6:
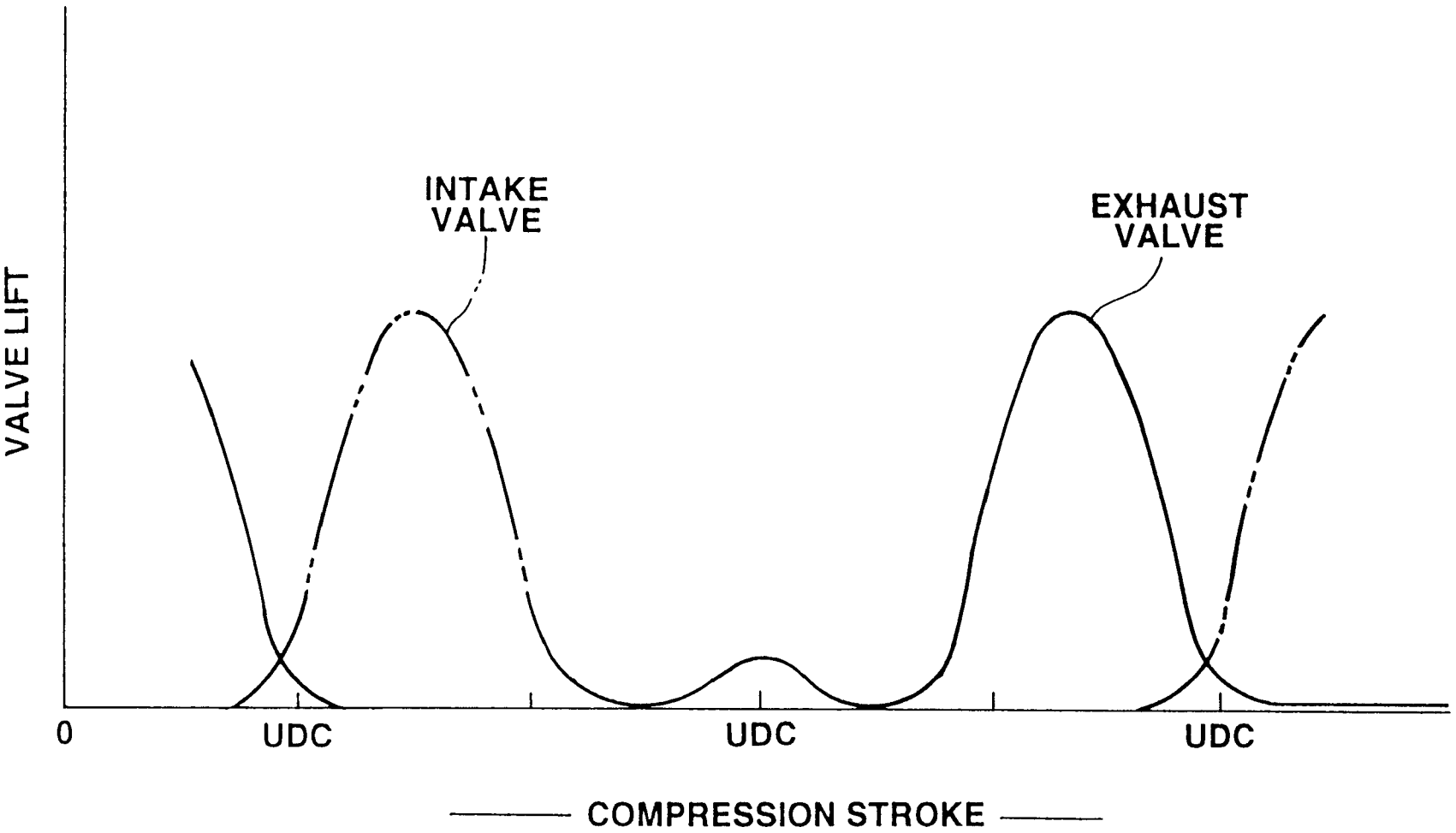
FIG. 6 is a graph showing the opening/closing timing of an exhaust valve as well as an intake valve under compression stroke, which is exhibited by the diesel engine to which the invention is applied.

When, upon YES judgement by the control unit 35, the unit 35 energizes the switching valve 36, the valve 36 is shifted to the oil feeding position. Thus, due to work of the oil pump 32, the pressurized oil is led to the oil chamber 26 to shift the slider 24 to the work position as is shown in FIG. 5 and thus the plunger 23 assumes the upper position. Thus, under this condition, the plunger 23 is operatively engaged with the engine brake cam 22, so that the exhaust valve 14 is forced to act in a manner as is depicted by the graph of FIG. 6. That is, when, under compression stroke, a corresponding piston (not shown) moves up near a top dead center, the exhaust valve 14 is somewhat opened thereby to partially discharge the combustion pressure in the combustion chamber 11 to the exhaust port 12. That is, under the compression stroke, the engine is forced to carry out a negative working which corresponds to engine braking.

What is claimed is:

1. A decompression engine brake device for use with an internal combustion engine, comprising:

an exhaust valve arranged to open and close an exhaust port extending from a combustion chamber of the engine;

a valve stem extending from said exhaust valve;

a valve lifter slidably disposed in a cylinder head of the engine, said valve lifter having said valve stem in contact therewith;

an exhaust cam shaft;

an exhaust cam disposed about said exhaust cam shaft and operatively engageable with said valve lifter to actuate said exhaust valve in accordance with a contour of said exhaust cam;

an engine brake cam defined by said exhaust cam;

a plunger axially movably held by said valve lifter, said plunger having an upper end that is operatively engageable with said engine brake cam;

a slider transversely movably held in said valve lifter, said slider having an inclined surface which a lower end of said plunger slidably contacts; and an actuating device for moving said slider in first and second directions thereby axially moving said plunger.

2. A decompression engine brake device as claimed in claim 1, in which a peripheral surface of said engine brake cam is constituted by a bottom surface of a groove which is formed in and around said exhaust cam.

3. A decompression engine brake device as claimed in claim 1, wherein:

said plunger engages said engine brake cam when said plunger assumes a projected position; and said actuating device is hydraulically actuated.

4. A decompression engine brake device as claimed in claim 3, further comprising a shim detachably fixed to an upper side of said valve lifter and through which said plunger passes.

5. A decompression engine brake device as claimed in claim 3, further comprising:

a bore formed in said valve lifter and having said slider slidably disposed therein;

a biasing member that biases said slider in said first direction; and an oil chamber that moves said slider in said second direction when fed with pressurized oil, said second direction being opposite to said first direction, wherein when said slider is moved in said second direction by said pressurized oil, said inclined surface pushes up said plunger into said projected position.

6. A decompression engine brake device as claimed in claim 5, further comprising:

an oil passage defined in said cylinder head, said oil passage being communicated with said oil chamber;

an oil pump;

a draining passage;

an electromagnetic switching valve that assumes a first position to connect said oil passage to said draining passage and a second position to connect said oil passage to said oil pump; and a control unit which energizes said switching valve to take said second position when an engine braking is needed.

7. A decompression engine brake device as claimed in claim 5, in which said inclined surface constitutes a bottom surface of an axially extending recess formed in said slider, said bottom surface being inclined with respect to a longitudinal axis of said slider.

8. A decompression engine brake device as claimed in claim 7, in which the lower end of said plunger is formed with an inclined surface which is slidably engaged with said inclined bottom surface of the recess of said slider.

9. A decompression engine brake device as claimed in claim 1, in which the contour of said engine brake cam is so shaped that when, under compression stroke, a corresponding piston moves up near a top dead center, the exhaust valve is slightly opened to partially discharge a compression pressure in the combustion chamber to the exhaust port.

10. A decompression engine brake device for use with an internal combustion engine, comprising:

an exhaust valve arranged to open and close an exhaust port extending from a combustion chamber of the engine;

a valve step extending from said exhaust valve;

a valve lifter slidably disposed in a cylinder head of the engine, said valve lifter having said valve stem contacting thereto;

a first biasing member for biasing said valve lifter and thus said exhaust valve in a direction to close said exhaust port;

an exhaust cam shaft positioned above said valve lifter;

an exhaust cam disposed about said exhaust cam shaft and operatively engageable with said valve lifter to actuate said exhaust valve in accordance with a contour of said exhaust cam;

an engine brake cam defined by said exhaust cam;

a plunger axially movably held by said valve lifter, said plunger having an upper end which is operatively engageable with said engine brake cam when said plunger assumes a projected position;

a bore formed in said valve lifter;

a slider slidably disposed in said bore;

a second biasing member for biasing said slider in a first direction;

an oil chamber defined by said bore, said oil chamber biasing said slider in a second direction when fed with a pressurized oil, said second direction being opposite to said first direction; and an inclined surface defined by said slider, said inclined surface being slidably engaged with a lower end of said plunger, so that when said slider is moved in said second direction by said pressurized oil, said inclined surface pushes up said plunger to cause the same to take said projected position.

11. A decompression engine brake device for use with an internal combustion engine, comprising:

an exhaust valve arranged to open and close an exhaust port extending from a combustion chamber of the engine;

a valve stem extending from said exhaust valve;

a valve lifter slidably disposed in a cylinder head of the engine, said valve lifter having said valve stem in contact therewith;

an exhaust cam shaft;

an exhaust cam disposed about said exhaust cam shaft and operatively engageable with said valve lifter to actuate said exhaust valve in accordance with a contour of said exhaust cam;

an engine brake cam defined by said exhaust cam; and a first unit for inducing an operative engagement between said engine brake cam with said valve lifter thereby to actuate said exhaust valve in accordance with a contour of said engine brake cam and including:

a plunger axially movably held by said valve lifter, said plunger having an upper end which is operatively engageable with said engine brake cam when said plunger assumes a projected position; and a hydraulically operated second unit that forces said plunger in said projected position when hydraulically actuated, wherein said second unit comprises:

a bore formed in said valve lifter and having said slider slidably disposed therein;

a biasing member that biases said slider in a first direction; and an oil chamber that moves said slider in a second direction when fed with pressurized oil, said second direction being opposite to said first direction, wherein when said slider is moved in said second direction by said pressurized oil, said inclined surface pushes up said plunger into said projected position.

12. A decompression engine brake device as claimed in claim 11, further comprising:

an oil passage defined in said cylinder head, said oil passage communicating with said oil chamber;

an oil pump;

a draining passage;

an electromagnetic switching valve that assumes a first position to connect said oil passage to said draining passage and a second passage to connect said oil passage to said oil pump; and a control unit that energizes said switching valve into said second position when an engine braking is needed.

13. A decompression engine brake device as claimed in claim 11, in which said inclined surface constitutes a bottom surface of an axially extending recess formed in said slider, said bottom surface being inclined with respect to a longitudinal axis of said slider.

14. A decompression engine brake device as claimed in claim 13, in which the lower end of said plunger is formed with an inclined surface that is slidably engaged with said inclined bottom surface of the recess of said slider.

* * * * *